US008689751B2

(12) United States Patent
Kubo et al.

(10) Patent No.: US 8,689,751 B2
(45) Date of Patent: Apr. 8, 2014

(54) ROCKER ARM STRUCTURE

(75) Inventors: Katsuhiro Kubo, Wako (JP); Yuki Uzawa, Wako (JP); Masahiro Nakashima, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 370 days.

(21) Appl. No.: 13/021,329

(22) Filed: Feb. 4, 2011

(65) Prior Publication Data

US 2011/0209679 A1 Sep. 1, 2011

(30) Foreign Application Priority Data

Feb. 26, 2010 (JP) ..... 2010-042719

(51) Int. Cl.
*F01L 1/18* (2006.01)

(52) U.S. Cl.
USPC ..... 123/90.39; 123/90.4; 123/90.44

(58) Field of Classification Search
USPC ..... 123/90.39, 90.4, 90.44
IPC ..... F01L 1/18,1/34
See application file for complete search history.

(56) References Cited

U.S. PATENT DOCUMENTS

| | | | | | |
|---|---|---|---|---|---|
| 1,467,964 | A * | 9/1923 | Postel-Vinay | 74/519 |
| 3,633,556 | A * | 1/1972 | Inoue | 123/90.22 |
| 3,641,988 | A * | 2/1972 | Torazza et al. | 123/90.16 |
| 3,690,958 | A * | 9/1972 | Thompson | 148/542 |
| 4,694,788 | A * | 9/1987 | Craig | 123/90.16 |
| 4,840,150 | A * | 6/1989 | Kotzab et al. | 123/90.39 |
| 4,955,121 | A * | 9/1990 | Sato et al. | 29/888.2 |
| 5,185,923 | A * | 2/1993 | Taniguchi et al. | 29/888.03 |
| 5,251,585 | A * | 10/1993 | Graber | 123/90.39 |
| 5,669,344 | A * | 9/1997 | Regueiro | 123/90.22 |
| 6,293,238 | B1 * | 9/2001 | Harmon | 123/90.16 |
| 7,293,539 | B2 * | 11/2007 | Hayward et al. | 123/90.39 |
| 7,938,089 | B2 * | 5/2011 | Yamamoto | 123/90.16 |
| 8,191,522 | B2 * | 6/2012 | Riley | 123/90.39 |
| 8,215,275 | B2 * | 7/2012 | Church | 123/90.39 |
| 8,240,278 | B2 * | 8/2012 | Jeon et al. | 123/90.12 |
| 8,267,059 | B2 * | 9/2012 | Manther et al. | 123/90.39 |
| 2009/0038572 | A1 * | 2/2009 | Langewisch et al. | 123/90.44 |
| 2009/0056654 | A1 * | 3/2009 | Yamamoto | 123/90.17 |

FOREIGN PATENT DOCUMENTS

| | | | | |
|---|---|---|---|---|
| DE | 4229411 | A1 | 3/1994 | |
| DE | 19715804 | A1 | 10/1998 | |
| DE | 10 2008 015197 | A1 | 10/2008 | |
| DE | 10 2008 015216 | A1 | 10/2008 | |
| DE | 10 2008 015218 | A1 | 10/2008 | |
| DE | 10 2008 020155 | A1 | 10/2008 | |
| EP | 80175 | A1 * | 6/1983 | F01L 1/16 |
| JP | 62-000711 | U | 1/1987 | |

(Continued)

*Primary Examiner* — Thai Ba Trieu
*Assistant Examiner* — Thomas Olszewski
(74) *Attorney, Agent, or Firm* — Westerman, Hattori, Daniels & Adrian, LLP

(57) ABSTRACT

The disclosed structure achieves a desired balance between higher-rigidity and weight saving in a connection-type rocker arm which integrally rocks a plural of arm portions. The rocker arm has a plurality of arm portions integrally formed on a swinging base end side of the rocker arm which are forked and extend towards a swinging end of the rocker arm, a connecting portion which integrally connects each swinging end of the arm portions, and a concave thinning portion which overlaps a swinging trajectory of the connecting portion, when viewed in the axis direction of the pivot shaft of the rocker arm.

20 Claims, 7 Drawing Sheets

(56) References Cited

FOREIGN PATENT DOCUMENTS

| | | | |
|---|---|---|---|
| JP | 10-158772 | A | 6/1998 |
| JP | 11-218006 | A | 8/1999 |
| JP | 2001-182507 | A | 7/2001 |
| JP | 2005-214131 | A | 8/2005 |
| JP | 2008-248870 | A | 10/2008 |

* cited by examiner

ROCKER ARM STRUCTURE

TECHNICAL FIELD

Disclosed is a structure of a rocker arm in an internal combustion engine.

BACKGROUND OF THE INVENTION

In a rocker arm structure wherein the rocker arm disposed between a cam of a camshaft and a valve urges the valve by being urged and swung by the cam, there is a conventional example wherein a pair of arm portions are extended toward a pair of valves adjacent to each other and the rocker arm is integrally formed by connecting each arm portion.

SUMMARY OF THE INVENTION

In the connection-type rocker arm mentioned above, the arm portions cooperate with each other. In order not to make the differences in the operation characteristics (including lift amount and timing) of the valves adjacent to each other, it is needed to improve molding accuracy as well as to enhance the rigidity of the rocker arm for limiting the deformation during operation. For instance, it is known to enhance the rigidity by thickening the wall of each arm portion. In such a case, the rocker arm with a heavier weight would not be capable of enduring a use in a high-speed rotation range. Therefore, it is preferable to achieve a desired balance between high-rigidity and weight saving in the connection-type rocker arm.

The disclosed rocker arm achieves the desired balance between higher-rigidity and weight saving in a connection-type rocker arm wherein a plural of arm portions are integrally swung.

Disclosed is a structure of a rocker arm disposed between a cam (of a camshaft and a valve which urges the valve by being urged and swung by the cam, the rocker arm structure includes a plurality of arm portions integrally formed on the swinging base end thereof as well as forked and extended to the swinging end of the rocker arm which are forked and extended to a swinging end of the rocker arm, a connecting portion which integrally connects the swinging end of each arm portion, a concave thinning portion is formed so as to overlap a swing trajectory of the connecting portion, when viewed in the axis direction of the pivot shaft of the rocker arm.

Further, each arm portion has a cam urging portion urged by the cams and a valve urging portion urging the valves on each swinging end of the rocker arm, when viewed in the axis direction of the pivot shaft. The valve urging portion is wider than the cam urging portion. The space between the valve urging portion and the cam urging portion is formed in a substantially triangular shape. The thinning portion is formed in a substantially triangular shape in the triangular space.

Further, the rocker arm can shift with a camshaft which has a plural of cams per valve in the axis direction of the pivot shaft, thereby the rocker arm can be used for a variable valve mechanism which switches operation characteristics of the valve by a variety of cams. The connecting portion continuously connects the cam urging portion and the valve urging portion in the axis direction of the pivot shaft. The thinning portion is formed only on the outside of the triangular portion between the cam urging portion and valve urging portion in the direction parallel to each arm portion. The wall portion is formed on the inside of the triangular portion in the direction parallel to each arm portion.

Further, the width of the valve urging portion in the axis direction of the pivot shaft is larger than the width of the cam urging portion in the axis direction of the pivot shaft. The connecting portion bridges the valve urging portions on each arm portion.

Further, the thinning portion is formed so as to notch a part of the connecting portion when viewed in the axis direction of the pivot shaft.

Further, each arm portion is provided so as to be spaced apart, the space thereof becomes wider as it approaches each swinging end. The arm portions and connecting portion are positioned so as to form a substantially triangular shape when viewed in a plane perpendicular to the axis direction of the pivot shaft.

Further, the thickness of the cam urging portions decreases towards the outside of the substantially triangular portion, in axis direction of the pivot shaft.

Further, the rocker arm is molded and the thinning portion is also formed at the time of molding.

In a rocker arm wherein a plurality of arm portions are connected, the swinging end of each arm portion is connected, and the rocker arm is thinned on the swinging edge of each arm portion as well as in the swinging trajectory of the connecting portion, the rigidity of the rocker arm can be enhanced while limiting the weight increase by the connecting portion on the swinging end. Thus, a high-rigid and light-weight rocker arm can be provided so as to be operational even in a high-speed rotation range.

Further, the swinging end of each arm portion is formed in a substantially triangular shape (truss-shape) when viewed in the axis direction of the pivot shaft. Thereby, it can be possible to secure strength, while thinning is provided on the swinging end of each arm portion.

In a variable valve mechanism which switches operation characteristics of the valve by shifting the rocker arm in the axis direction of the pivot shaft, even if the connecting portion is subjected to a load when the valve is urged, the wall portion can support the load and reduce the moment acting on the connection portion, and limit the deflection thereof by providing the thinning only on the outside of said triangular portion and a wall portion on the inside thereof.

The connecting portion connects the valve urging portions, each of which is wider than the cam urging portion in the arm portion. Thereby, it is possible to reduce weight by limiting the length of the connecting portion as well as to reinforce the valve urging portions.

The connecting portion can be reduced in weight more by forming the concave thinning portion to notch a part of the connecting portion.

Each arm portion and a connecting portion are positioned in a substantially triangular shape (truss-shape) when viewed in plan view, thus the strength and rigidity can be enhanced.

The strength and rigidity can be enhanced as the wall thickness at the wall portion side (the base end) of the cam urging portion is thicker.

The core mold forming the thinning portion can easily be unmolded outside in the parallel direction to each arm portion, thus the manufacturing process can be easier.

BRIEF DESCRIPTION OF THE DRAWINGS

The advantages of the invention will become apparent in the following description taken in conjunction with the drawings, wherein:

FIG. 2(*a*) shows a state which is in the operational position of the low-speed side cams;

FIG. 2(*b*) shows a state which is in the operational position of the high-speed side cams, respectively;

DETAILED DESCRIPTION OF THE INVENTION

Hereinafter, the embodiments will be described with reference to the drawings. Meanwhile, directions including "front", "rear", "left", "right" are same as directions of a vehicle unless otherwise stated. In addition, an arrow of FR shows the front of the vehicle, an arrow of LH shows the left side of the vehicle, and arrow of UP shows the upper side of the vehicle, respectively.

Figure 1:
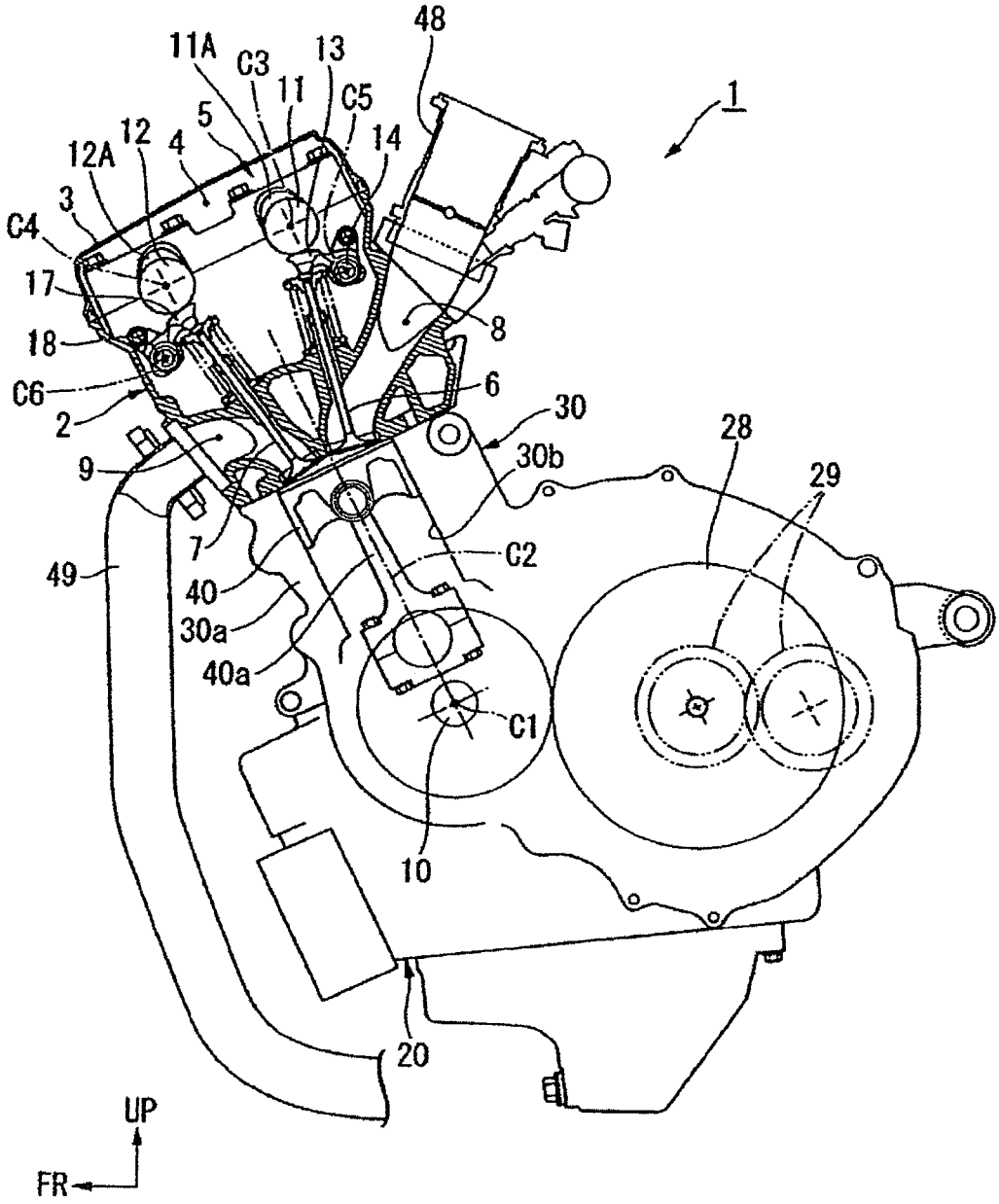
FIG. 1 is a left side view of the engine.

FIG. 1 is the left side view of a 4-stroke DOHC straight 4-cylinder engine 1 (or an internal combustion engine, which will be described as the engine, hereinafter) which is used for a motor of small vehicles such as motorcycle. That is, the engine 1 comprises the crankshaft 10 of which rotation axis (crankshaft axis) C1 is disposed in the width direction (the left and right direction) of the vehicle and a cylinder 30 vertically arranged in a forward inclined position (the upper portion thereof is inclined so as to be arranged forward) on the upper side of a crankcase 20. In addition, the numeral reference C2 shows an axis (a cylinder axis) along the standing direction of the cylinder 30.

The cylinder 30 mainly comprises the cylinder main body 30*a* standing above the crankcase 20, a cylinder head 2 continuously arranged above the cylinder main body 30*a*, a head cover 3 covering the upper side of the cylinder head 2.

In the cylinder main body 30*a*, a cylinder bore 30*b* respectively corresponding to each cylinder is formed side by side along the crankshaft axis C1, pistons 40 are reciprocatably fitted into each cylinder bore 30*b*. The reciprocating movement of each piston 40 is converted into the rotation of the crankshaft 10 through a connecting rod 40*a*, and the rotating power is output outside the engine through a clutch 28 stored inside the rear of the crankcase 20 and a transmission 29.

The reference number 4 in the drawing shows a valve chamber comprising the cylinder head 2 and the head cover 3, the reference number 5 shows the valve mechanism which is stored inside the valve chamber 4 and driving intake valves 6 and exhaust valves 7, the reference numbers 8, 9 respectively show intake port and exhaust port, which are provided in front and back of the cylinder head 2, the reference numbers 11, 12 respectively show intake side camshaft and exhaust side camshaft, the reference number 48 shows the throttle body which is connected to the rear of the cylinder head 2, the reference number 49 shows an exhaust pipe which is connected to the front of the cylinder head 2.

As mentioned below, the valve mechanism 5 is formed as a variable valve mechanism capable of switching the cams between the high-speed side and low-speed side for opening and closing of each valve 6 and valve 7.

The intake ports 8 and the exhaust ports 9 respectively form a pair of combustion chamber side openings per cylinder, each combustion chamber side opening is opened and closed by a pair of intake valves 6 and exhaust valves 7, respectively. That is, the engine 1 is formed in a four-valve type, and each cylinder has the right and left pair of intake valves 6 and exhaust valves 7.

The right and left pair of intake valves 6 per cylinder are urged and then opened and closed by the cams 11A of the intake side camshaft 11 through the intake side rocker arm 13 which is provided per cylinder. Similarly, the right and left pair of exhaust valves per cylinder are urged and then opened and closed by the cams 12A of the exhaust side camshaft 12 through the exhaust side rocker arm 17 provided per cylinder.

The intake side rocker arm 13 is supported swingably about the axis and slidably in the axis direction by an intake side rocker arm shaft 14 arranged parallel to the intake side camshaft 11 in the rear of the stem edge portion of the intake valve 6. Similarly, the exhaust side rocker arm 17 is supported swingably about the axis and slidably in the axis direction by an exhaust side rocker arm shaft 18 arranged parallel to the exhaust side camshaft 12 in front of the stem edge of the exhaust valve 7. In addition, the numeral references C3, C4 show the central axis (camshaft axes) of each camshaft 11, 12, the numeral references C5, C6 show the central axis (rocker axes) of each rocker arm shaft 14, 18, respectively.

Hereinafter, the example of the intake side per cylinder in the valve mechanism 5 will be described with reference to FIG. 2 to 5. The intake sides of the other cylinders and the exhaust sides of each cylinder shall have the same structure unless otherwise stated.

In the rocker arm 13, the rocker arm shaft 14 is inserted into a cylindrical base portion (shaft insert boss) 13*a* from which the arm portions 13*b* extend to the stem edge portions of the intake valves 6. The cam slidably contacting portions 13*c* which slidably contact the cams 11A of the camshaft 11 are provided above the edge portions of the arm portions 13*b*. The valve urging portions 13*d* which abut against and downwardly urge the stem edge portions are provided below the edge portions of the arm portions 13*b*.

The rocker arm 13 is supported by the rocker arm shaft 14 swingably around the axis (the axis C5 centered) and slidably in the axis direction (the direction along the axis C5, hereinafter mentioned as the axis C5 direction). The rocker arm 13 is extensively and integrally provided over the right and left intake valves 6 in the right and left direction. In the rocker arm 13, the cam slidably contacting portions 13*c* and the valve urging portions 13*d* are spaced apart on the right and left sides, and provided in pairs.

Then, the arm portions 13*b* are provided in pairs so as to be forked and extended from the swinging base end (the base portion 13*a* side) to the swinging end (the intake valve 6 sides) in the axis direction of the pivot shaft (the axis C5 direction, the right and left direction). The swinging base end (the base portion 13*a* side) of each arm portion 13*b* are joined together and integrally formed. Thus, the right and left arm portions 13*b* are provided in a substantially V-shape when viewed in a plane perpendicular to the axis direction of the pivot shaft (when viewed from the upper surfaces in FIGS. 2, and 4). The cam slidably contacting portions 13*c* and the valve urging portions 13*d* are provided on the swinging end of each arm portion 13*b*, respectively.

Figure 3:
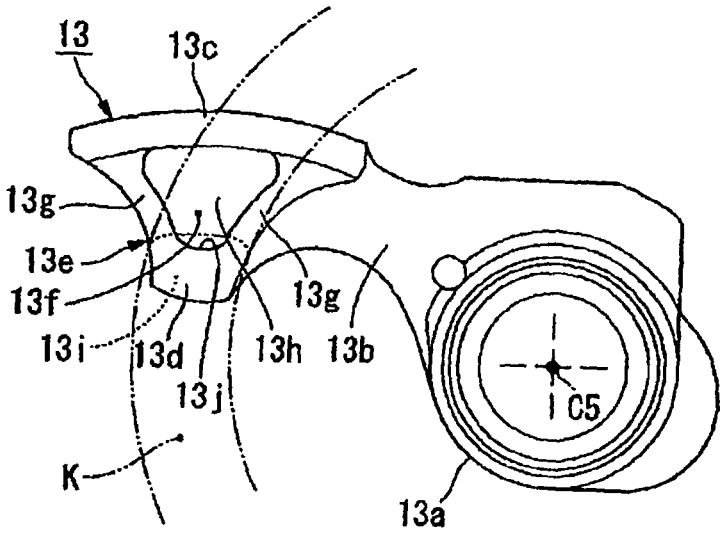
FIG. 3 is a side view of the rocker arm mentioned above.
Figure 4:
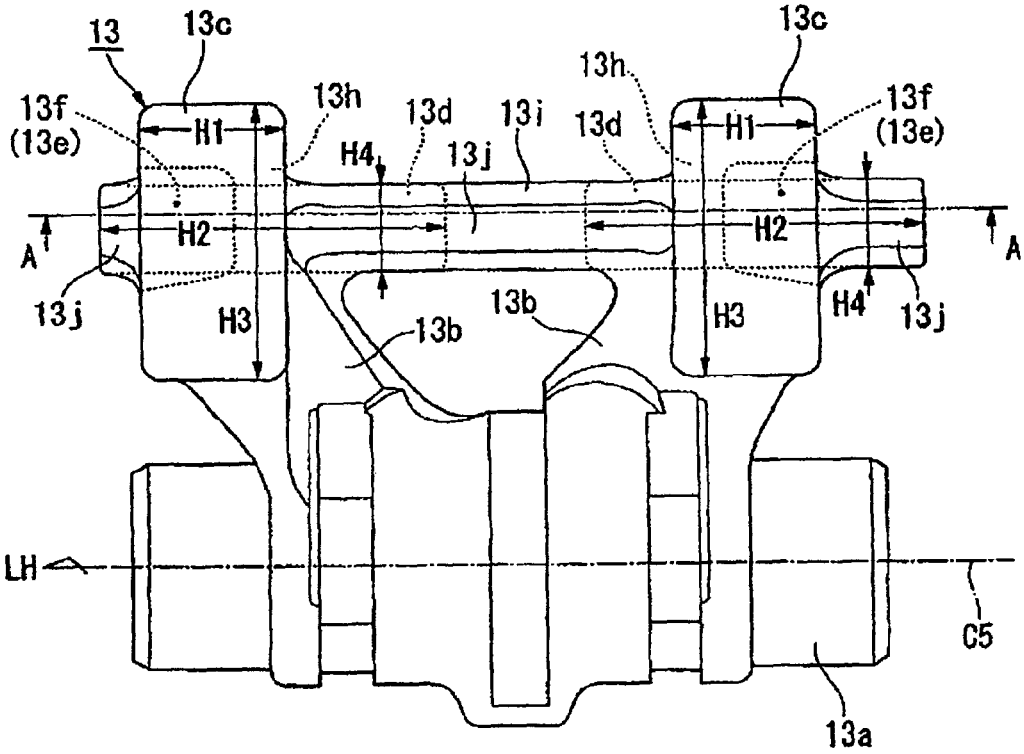
FIG. 4 is a plan view of the rocker arm mentioned above.

The width H3 in the vertical direction of the cam slidably contacting portions 13*c* in FIG. 4 (substantially in the axis direction of swinging radial of the rocker arm 13) is provided larger than the width H4 in the vertical direction of the valve urging portions 13*d* in FIG. 4 (substantially in the swinging radial direction of the rocker arm 13). Thereby, on the swinging end of each arm portion 13*b*, the triangular portion 13*e* is formed in an inverted triangular shape in the space between the cam slidably contacting portion 13*c* and the valve urging portion 13*d* when viewed from the axis direction of the pivot shaft (when viewed following an arrow along the axis C5) showed in FIG. 3.

Figure 6:
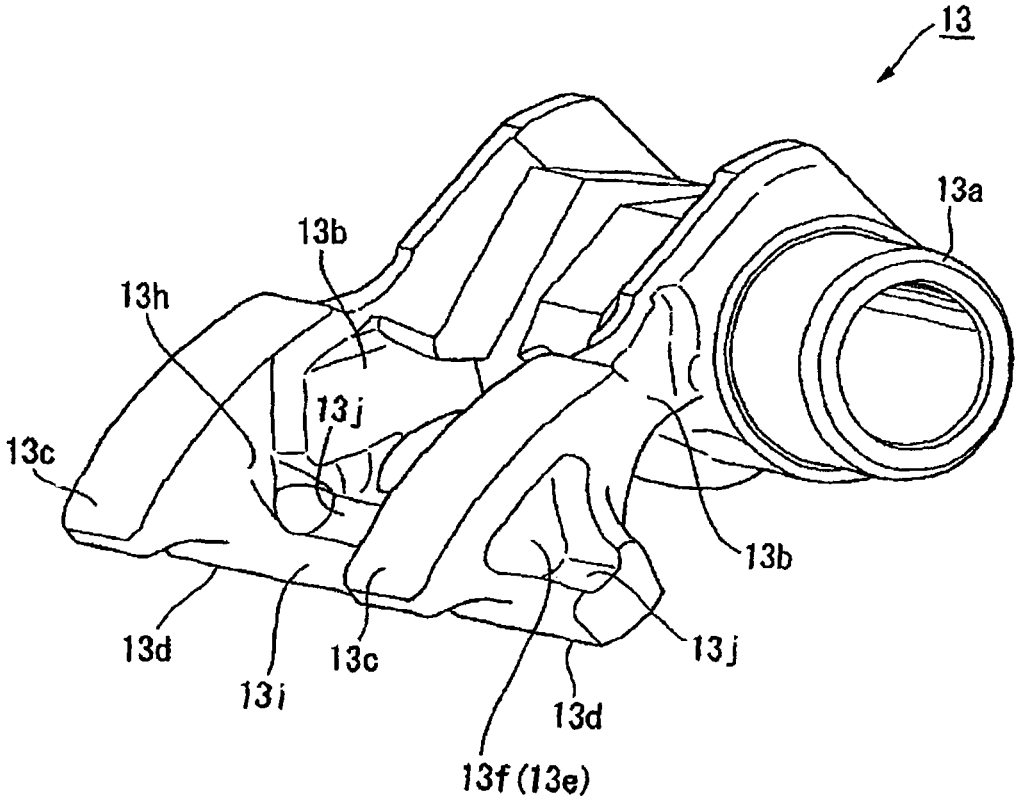
FIG. 6 is a perspective view of the rocker arm mentioned above.

With additional reference to FIG. 6, each concave thinning portion 13*f* opening toward the outside of the cylinder is formed in the position outside the corresponding cylinder (outside in the direction parallel to each arm portion 13*b*, the right and left direction, outside in the axis direction of the pivot shaft) in the triangular portion 13*e*.

The thinning portions 13*f* are in a substantially similar shape (inverted triangular shape) which is slightly smaller than the triangular portions 13*e* when viewed in the axis direction of the pivot shaft. In the front and rear of the thinning portions 13*f*, front and rear walls 13*g* bridging the cam slidably contacting portion 13*c* and the valve urging portion 13*d* are formed in the convexed and arcuate shape inside the triangular potion 13*b* when viewed in the axis direction of the pivot shaft.

The cam slidably contacting portion 13*c* above the thinning portion 13*f* is formed in a wall shape (plank-shape) with a predetermined thickness in the vertical direction of FIG. 3 (substantially in the swinging direction of the rocker arm 13). Similarly, the valve urging portion 13*d* below the thinning portion 13*f* is formed in a wall shape with a predetermined thickness in the vertical direction of FIG. 3 (substantially in the swinging direction of the rocker arm 13). The cam slidably contacting portion 13*c* forms an arcuate upper surface (cam contacting surfaces) convexed upward when viewed in the axis direction of the pivot shaft. The valve urging portion 13*d* forms the arcuate valve urging surface convexed downward when viewed in the axis direction of the pivot shaft.

Plank-shaped inside wall 13*h*, which is substantially perpendicular to the axis direction of the pivot shaft, is formed in the position inside the corresponding cylinder (inside in the direction parallel to the arm portions 13*b*, the right and left direction, inside in the axis direction of the pivot shaft).

The swinging ends of the left and right arm portions 13*b* are integrally connected to the left and right cam slidably contacting portions 13*c*, valve urging portions 13*d* and the triangular portions 13*e*, respectively. With this structure, the swinging ends of the left and right arm portions 13*b* are integrally connected to the inside walls 13*h* of the triangular portions 13*e*, thereby improving the strength and rigidity on the swinging end of the rocker arm 13 while providing the thinning portion 13*f* to the triangular portion 13*e*.

In addition, when operating the engine 1, each of camshaft 11, 12 is in a rotary drive in conjunction with the crankshaft 10. Accordingly, each rocker arm 13, 17 urges the intake valves 6 and exhaust valves 7 respectively, by rocking each rocker arm 13, 17 according to the periphery pattern of each cam 11A, 12A, and opens and closes the opening of the combustion chamber of the intake ports 8 and exhaust ports 9 by appropriately permitting these intake valves 6 and exhaust valves 7 to reciprocatably move.

As mentioned above, the valve mechanism 5 is configured as a variable valve mechanism which can switch the valve opening and closing timing and lift amount of each of valves 6, 7. The variable valve controlling system including the valve mechanism 5 permits each of valves 6, 7 to open and close using the low-speed operation cam in each camshaft 11, 12 in the low-speed operational range of the engine speed less than 9000 rpm, for example, and permits each of valves 6, 7 to open and close using the high-speed operation cam in each camshaft 11, 12 in high-speed operational range of the engine speed at 9000 rpm and above, for example.

Figure 2A:
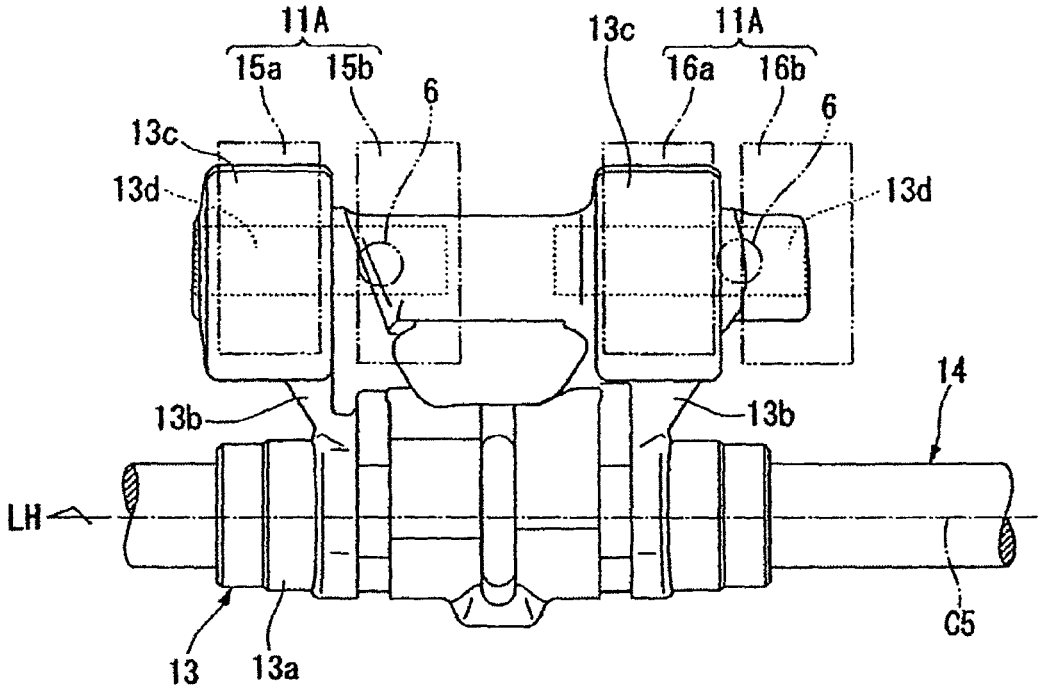
FIG. 2 is a plan view about the rocker arm of the engine mentioned above.
Figure 2B:
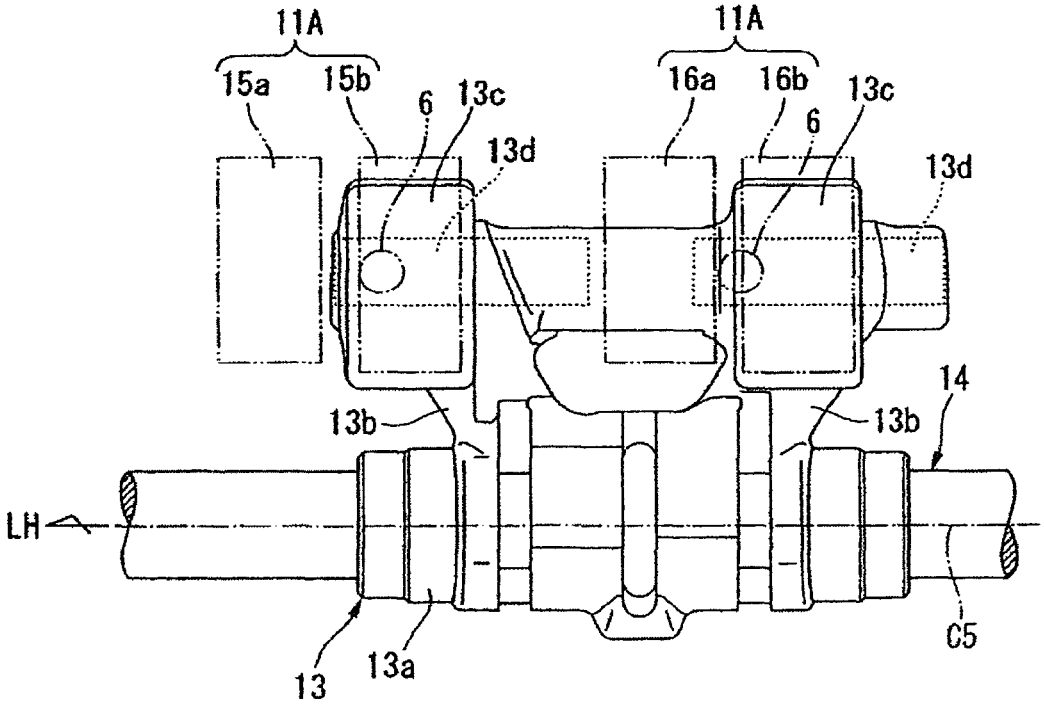

Referring to FIG. 2, the cam 11A of the camshaft 11 comprises right and left first valve cams 15*a*, 16*a* for low-speed operational range and right and left second valve cams 15*b*, 16*b* for high-speed operational range. More specifically, the camshaft 11 has four cams in total: the left and right first cams 15*a*, 16*a* and the left and right second cams 15*b*, 16*b* per cylinder.

The left and right first cams 15*a*, 16*a* have the same shape, while the left and right second cams 15*b*, 16*b* have the same shape. The left first cams 15*a* and the left second cams 15*b* are contact adjacent with each other in the left-right direction (axis direction of cam shaft) on the cylinder left side, while the right first cams 16*a* and the right second cams 16*b* are contact adjacent with each other in the left-right direction (axis direction of cam shaft) on the cylinder right side.

The rocker arm 13 is in the position limiting the movement to the left in the axis 5 direction during the deactivation of the engine 1 and the driving time in the low-speed operational range (see FIG. 2 (*a*)). The left and right cam slidably contacting portions 13*c* of rocker arm 13 are positioned at the position slidably connected to the outer circumference surface (cam surface) below the left and right first cams 15*a*, 16*a*, respectively. The left and right valve urging portions 13*d* are positioned in the position (the first operational position) where it can urge the stem edge portion of the left and right intake valves 6 on the right side portion. With this configuration, the rocker arm 13 is swung by the low-speed left and right first cams 15*a*, 16*a*, which permits the intake valve 6 to open and close.

On the other hand, the rocker arm 13 is in the position limiting the movement to the right in the axis C5 direction in the high-speed operational range of the engine 1 (see FIG. 2(*b*)). The left and right cam slidably contacting portions 13*c* of the rocker arm 13 are positioned in the position slidably connected to the outer circumference surface (cam surface) below the left and right second cams 15*b*, 16*b*, respectively. The left and right valve urging portions 13*d* are positioned in the position (the second operational position) where it can urge the stem edge portion of the left and right intake valves 6 on the left side portion. With this configuration, the rocker arm 13 is swung by the high-speed left and right second cams 15*b*, 16*b*, which permits the intake valve 6 to open and close.

The valve mechanism 5 stores power enough to move the rocker arm 13 in the axis C5 direction in the rocker arm movement mechanism (not shown) according to the engine speed, moves the rocker arm 13 to either of the first operational position or the second operational position with such power, thereby enabling to alternatively use either of the left and right first cams 15*a*, 16*a* or the left and right second cams 15*b*, 16*b* for opening and closing operation of the intake valve 6.

The rocker arm shaft 14 is movably supported in the axis C5 direction by the cylinder head 2, and moves in the axis C5 direction by the operation of an actuator (not shown) and the like. Accordingly, the power to move the rocker arm 13 will be stored in the rocker arm movement mechanism.

The rocker arm shaft 14 is in the position limiting the movement to the left in the axis C5 direction during the deactivation of the engine 1 and the low-speed operation time, keeping the low-speed operational range (see FIG. 2 (*a*)).

On the other hand, the rocker arm shaft 14 is in the position limiting the movement to the right in the axis C5 direction at the high-speed operation time of the engine 1, keeping the high-speed operational range (see FIG. 2 (*b*)).

Moreover, when moving the rocker arm 13 from one end to another of each operational position, the power is stored in the rocker arm movement mechanism to integrally move the rocker arm shaft 14 and the like in the axis C5 direction to the cylinder head 2 and to move the rocker arm 13 while the movement of the rocker arm 13 in the axis C5 direction is restricted using a moving restriction mechanism (not shown).

With such power, the rocker arm 13 is moved from one side to the other of each operational position.

As shown in FIG. 4, the width H2 in the axis direction of pivot shaft of the valve urging portion 13*d* of each arm portion 13*b* is made larger than the width H1 in the axis direction of pivot shaft of the cam slidably contacting portion 13*c* of each arm portion 13*b*. Each valve urging portion 13*d* is disposed in a position off-set to one side (to the right side in FIG. 4) in the axis direction of pivot shaft to each cam slidably contacting portion 13*c*.

Here, on the swinging end of each arm portion 13*b*, there are provided the connecting portion 13*i* integrally connecting the swinging ends of each arm portion 13*b*. The connecting portion 13*i* is like a rod extending along the axis direction of the pivot shaft, is provided so as to bridge the inside of each valve urging portion 13*d* in a parallel direction of each arm portion 13*b*, and is integrally formed so as to continuously connect to these valve urging portions mentioned above. Incidentally, the connection portion 13*i* may be integrally formed with these portions mentioned above so as to bridge the inside of each cam slidably contacting portion 13*c* in a parallel direction of each arm portion 13*b*.

Figure 5:
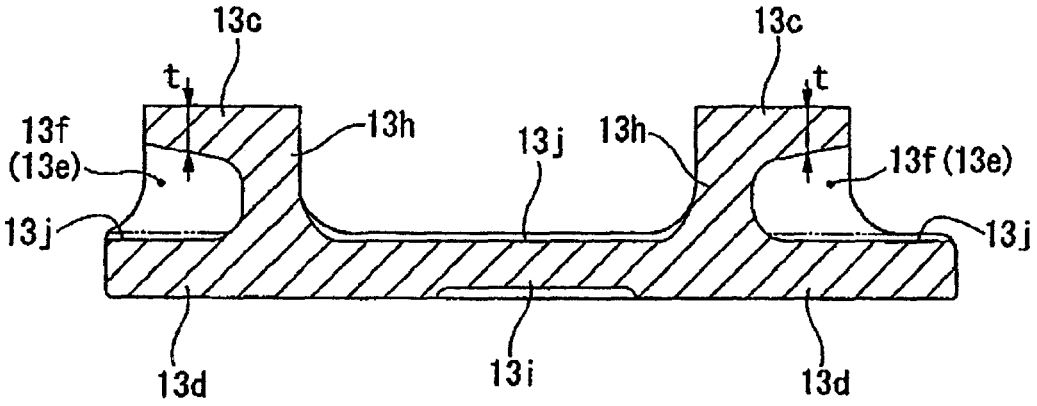
FIG. 5 is a sectional view taken along a line A-A of FIG. 4.

As shown in FIG. 3 to FIG. 5, on the swinging end of each arm portion 13*b*, the thinning portion 13*f* is provided so as to at least partially overlap a rocking trajectory K of the connection portion 13*i* in a view taken in the axis direction of pivot shaft.

Referring also to FIG. 6, the thinning portion 13*f* is in a substantially similar shape (an inverted triangle shape) which is slightly smaller than the triangular portion 13*e* in the axis direction of pivot shaft, and is recessed on the outside of the triangular portion 13*e* in a parallel direction of each arm portion 13*b*.

The outer surface of the triangular portion 13*e* is positioned the same as the outer edge of the cam slidably contacting portion 13*c* in the axis direction of pivot shaft, while the inner rim of the triangular portion 13*e* is positioned the same as the inner edge of the cam slidably contacting portion 13*c* in the axis direction of pivot shaft. The thinning portion 13*f* is recessed from the lateral surface of the triangular portion 13*e* to the position across the center in the axis direction of pivot shaft of the cam slidably contacting portion 13*c*.

The bottom end portion of the thinning portion 13*f* overlaps the upper end portion of the valve urging portion 13*d* and the connecting portion 13*i*. Thereby, the upper end portion of the valve urging portion 13*d* and the connecting portion 13*i* is notched by the bottom end portion of the thinning portion 13*f* to be formed in a concave shape. The concave portion which is notched on the upper end portion of the valve urging portion 13*d* and the connection portion 13*i* by providing the thinning portion 13*f* is shown as the reference number 13*j*.

Each arm portion 13*b* is provided in a substantially V-shape expanding as it approaches the swinging end in a plan view perpendicular to the axis direction of pivot shaft (see FIG. 4). It can be said that each arm portion 13*b* and the connection portion 13*i* are arranged so as to have a substantially triangular shape (truss-shaped) in the plan view.

The rocker arm 13 is integrally formed by aluminum die cast and the like. During die casting, the left and right thinning portions 13*f* are also formed. At this time, the core mold to form the thinning portion 13*f* is unmolded toward the outside of the cylinder in the axis direction of pivot shaft by die cutting. Therefore, the inside wall of the thinning portion 13*f* is formed in a tapered shape which is inclined so as to extend towards the outside of the cylinder (the opening side of the thinning portion 13*f*).

The cam slidably contacting portion 13*c* is formed in a wall shape (thick plate shape) with predetermined thickness in the vertical direction in FIGS. 3 and 5 (substantially in the swinging direction of the rocker arm 13). Referring to FIG. 5, since the inside wall of the thinning portion 13*f* is formed in a tapered shape which is inclined to extend towards the outside of the cylinder, a wall thickness t in the axis direction of pivot shaft of the cam slidably contacting portion 13*c* is provided so as to become thinner as it approaches the opening side of the thinning portion 13*f* (that is, so as to become thicker as it approaches the inside wall 13*h* side (the base end side of the cam slidably portion 13*c*)).

As described above, in the rocker arm structure of the embodiment in which the rocker arm 13 interposing between the cam 11A of the camshaft 11 and the valve 6 urges the valve 6 while swinging as a result of being urged by the cam 11A, the rocker arm 13 has a plurality of arm portions 13*b* integrally formed on the rocking base end side and branching to extend to the swinging end in the axis direction of pivot shaft, there is provided the connecting portion 13*i* integrally connecting the swinging ends of each arm portion 13*b* on the swinging end of each arm portion 13*b*, and the thinning portion 13*f* is provided so as to overlap the rocking trajectory K of the connecting portion 13*i* when viewed in the axis direction of pivot shaft of the rocker arm 13.

With this structure in a connection type of rocker arm 13 connecting a plurality of arm portion 13*b*, by connecting the swing end of each arm portion 13*b* with each other and by providing a thinning on the swinging end of each arm portion 13*b* as well as on the rocking trajectory K of the connecting portion 13*i*, the rigidity of the rocker arm 13 can be enhanced and the increase in weight on the rocker edge side for the connecting portion 13*i* can be limited. Consequently, it is possible to provide the highly-rigid and lightweight rocker arm 13 that is available even in the high rotation range.

In addition, the rocker arm structure is such that each arm portion 13*b* has the cam slidably contacting portion 13*c* urged by the cam 11A and the valve urging portion 13*d* urging the valve 6 on each swinging end; the valve urging portion 13*d* is formed larger in width than the cam slidably contacting portion 13*c* when viewed in the axis direction of pivot shaft; the area between the valve urging portion 13*d* and the cam slidably contacting portion 13*c* is formed in a substantially triangular shape, along which the thinning portion 13*f* is formed in a substantially triangular shape parallely to the triangular shape mentioned above.

With this structure, the strength can be ensured by forming the swinging end of each arm portion 13*b* in a substantially triangle shape (truss-shaped) when viewed in the axis direction of pivot shaft, while the thinning is provided to the swinging end of each arm portion 13*b*.

Furthermore, the rocker arm structure is such that the rocker arm 13 is used for the valve mechanism 5 which switches the operation characteristics of the valves 6 with different types of cams 15*a*, 16*a*, 15*b*, 16*b* by moving in the axis direction of pivot shaft to the cam shaft 11 having a plurality of cams 15*a*, 16*a*, 15*b*, 16*b* for a valve 6; the connecting portion 13*i* is continuously provided to the valve urging portion 13*d* in the axis direction of pivot shaft; the thinning portion 13*f* is formed only outside in a parallel direction of each arm portion 13*b* in the triangular portion 13*e* which lies between the cam slidably contacting portion 13*c* and the valve urging portion 13*d*; and the inside wall 13*h* as the bottom of the thinning portion 13*f* remains inside in a parallel direction of each arm portion 13*b* in the triangular shape 13*e*.

With this structure, in the variable valve mechanism which switches the operation characteristics of the valves 6 by moving the rocker arm 13 in the axis direction of pivot shaft, in case that a load acts on the connecting portion 13*i* when urging the valve 6, the inside wall 13*h* can also support the load by applying the thinning only to the outside of the triangular portion 13*e* and retaining the inside wall 13*h* inside thereof, which can suppress the moment acting on the connecting portion 13*i* and the deflection thereof.

Moreover, in the rocker arm structure of the present embodiment, the width H2 in the axis direction of pivot shaft of the valve urging portion 13*d* is set larger than the width H1 in the axis direction of pivot shaft of the cam slidably contacting portion 13*c*, and the connecting portion 13*i* connects the area between the valve urging portions 13*d* which are larger in width than the cam slidably contacting portion 13*c* on each arm portion 13*b* by providing the connecting portion 13*i* between the valve urging portions 13*d* of each arm portion 13*b*. As a result, it is possible not only to reduce the weight by limiting the length of the connecting portion 13*i* but also to reinforce the valve urging portion 13*d*.

Additionally, in the rocker arm structure of the present embodiment, the thinning portion 13*f* is formed so as to notch a part of the connecting portion 13*i* when viewed in the axis direction of pivot shaft, which can achieve the further reduction in weight of the connecting portion 13*i*.

Furthermore, in the rocker arm structure of the present embodiment, each arm portion 13*b* is provided expanding so as to be spaced apart with each other as it approaches the swinging end and each arm portion 13*b* and the connecting portion 13*i* are provided so as to form a substantially triangular shape in a plain view perpendicular to the axis direction of pivot shaft. Consequently, the strength and rigidity can be enhanced by arranging each arm portion 13*b* and the connecting portion 13*i* in a substantially triangle shape (truss-shaped) in a plan view.

In addition, in the rocker arm structure of the present embodiment, the cam slidably contacting portion 13*c* is formed in a wall shape with a predetermined thickness in the swinging direction of the rocker arm 13 by forming the thinning portion 13*f* and the wall thickness t in the swinging direction is formed thicker as it approaches the inside wall 13*h* side. Accordingly, the strength and rigidity can be enhanced by making the inside wall 13*h* side of the cam slidably contacting portion 13*c* (the base end side) thicker.

Besides, in the rocker arm structure of the present embodiment, the rocker arm 13 is made by die cast and the thinning portion 13*f* is formed at the same time. Thus, the core mold to form the thinning portion 13*f* can be easily stripped toward the outside in a parallel direction of each arm portion by die cutting, enabling an easy die cast.

The present invention, however, is not limited to the above-described embodiment. For example, the present invention may apply to the rocker arm of the conventional valve mechanism which is not a variable valve mechanism. Similarly, it may apply to the rocker arm of a SOHC engine, a single cylinder engine or V-type engine, and the rocker arm of various engines such as a longitudinal engine with a crankshaft directed in the front-rear direction of a vehicle.

The structure in the above-described embodiment is an example of the present invention. Therefore, it will be obvious that various switches may be made without departing from the scope of the invention.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A rocker arm structure disposed between a cam of a camshaft and a valve, and which urges said valve by being urged and swung by said cam, said rocker arm structure comprising:

a plurality of arm portions extending from a cylindrical base portion which rotates about a rocker arm shaft, said plurality of arm portions being forked in an axis direction of the cylindrical base portion and which extend away from an axis of said cylindrical base portion; and a connecting portion connecting swinging ends of said plurality of arm portions and being unitary with said arm portions, said connecting portion swinging on a swinging trajectory when said rocker arm is actuated by the camshaft, wherein said plurality of arm portions each include a concave thinning portion which overlaps a swinging trajectory of said connecting portion, when viewed in the axis direction of said cylindrical base portion.

2. The rocker arm structure according to claim 1, wherein each of said plurality of arm portions includes a cam urging portion, to be urged by the cam, and a valve urging portion, to urge the valve, wherein said valve urging portions are wider than said cam urging portions, in the axis direction of said cylindrical base portion, wherein said valve urging portions and said cam urging portions are joined by a substantially triangular portion, and wherein said concave thinning portions are disposed in said substantially triangular portions and have a substantially triangular shape.

3. The rocker arm structure according to claim 2, wherein said connecting portion continuously connects said cam urging portions or said valve urging portions of each of said plurality of arm portions, in the axis direction of said cylindrical base portion, wherein said concave thinning portions are disposed only on an outside of the substantially triangular portions, such that said concave thinning portions face away from each other, in the axis direction of said cylindrical base portion, and wherein wall portions are formed on an inside of the substantially triangular portions, such that said wall portions face towards each other, in the axis direction of said cylindrical base portion.

4. The rocker arm structure according to claim 2, wherein said connecting portion connects said valve urging portions on each of said plurality of arm portions.

5. The rocker arm structure according to claim 3, wherein said connecting portion connects said valve urging portions on each of said plurality of arm portions.

6. The rocker arm structure according to claim 1, wherein said concave thinning portions are formed as notches in a part of said connecting portion, when viewed in the axis direction of said cylindrical base portion.

7. The rocker arm structure according to claim 2, wherein said concave thinning portions are formed as notches in a part of said connecting portion, when viewed in the axis direction of said cylindrical base portion.

8. The rocker arm structure according to claim 3, wherein said concave thinning portions are formed as notches in a part of said connecting portion, when viewed in the axis direction of said cylindrical base portion.

9. The rocker arm structure according to claim 4, wherein said concave thinning portions are formed as notches in a part of said connecting portion, when viewed in the axis direction of said cylindrical base portion.

10. The rocker arm structure according to claim 5, wherein said concave thinning portions are formed as notches in a part of said connecting portion, when viewed in the axis direction of said cylindrical base portion.

11. The rocker arm structure according to claim 1, wherein said plurality of arm portions and said connecting portion form a substantially triangular shape in plan view.

12. The rocker arm structure according to claim 2, wherein said plurality of arm portions and said connecting portion form a substantially triangular shape in plan view.

13. The rocker arm structure according to claim 3, wherein said plurality of arm portions and said connecting portion form a substantially triangular shape in plan view.

14. The rocker arm structure according to claim 4, wherein said plurality of arm portions and said connecting portion form a substantially triangular shape in plan view.

15. The rocker arm structure according to claim 5, wherein said plurality of arm portions and said connecting portion form a substantially triangular shape in plan view.

16. The rocker arm structure according to claim 2, wherein a thickness of said cam urging portions decreases towards the outside of the substantially triangular portions, in the axis direction of said cylindrical base portion.

17. The rocker arm structure according to claim 3, wherein a thickness of said cam urging portions decreases towards the outside of the substantially triangular portions, in the axis direction of said cylindrical base portion.

18. The rocker arm structure according to claim 4, wherein a thickness of said cam urging portions decreases towards the outside of the substantially triangular portions, in the axis direction of said cylindrical base portion.

19. The rocker arm structure according to claim 5, wherein a thickness of said cam urging portions decreases towards the outside of the substantially triangular portions, in the axis direction of said cylindrical base portion.

20. The rocker arm structure according to claim 1, wherein said rocker arm structure is produced by molding said plurality of arm portions, including said concave thinning portions, at the same time as molding said connecting portion.

* * * * *